United States Patent [19]

Shinozaki et al.

[11] 4,425,774

[45] Jan. 17, 1984

[54] EXTRUSION FORGING METHOD THEREFOR

[75] Inventors: Kichitaro Shinozaki, Ibaraki; Kiyoshi Sato, Tokyo; Toru Shimizu, Ibaraki, all of Japan

[73] Assignees: Agency of Industrial Science and Technology; Ministry of International Trade and Industry, both of Tokyo, Japan

[21] Appl. No.: 304,815

[22] Filed: Sep. 23, 1981

[30] Foreign Application Priority Data

Sep. 29, 1980 [JP] Japan ..... 55-135432

[51] Int. Cl.[3] ..... B21C 35/03

[52] U.S. Cl. ..... 72/257; 72/345

[58] Field of Search ..... 72/253.1, 255, 257, 72/344, 345, 427

[56] References Cited

U.S. PATENT DOCUMENTS

| | | | |
|---|---|---|---|
| 1,317,238 | 9/1919 | Summey | 72/255 |
| 3,190,101 | 6/1965 | Caisley | 72/257 |
| 4,165,627 | 8/1979 | Boshold | 72/255 |
| 4,332,156 | 6/1982 | Broodman | 72/272 |

*Primary Examiner*—Lowell A. Larson

*Attorney, Agent, or Firm*—Kurt Kelman

[57] ABSTRACT

Apparatus for extrusion forging essentially comprises a double action hydraulic press composed of an inner ram. Extrusion forging of a billet is accomplished by placing the billet in a container and inserting a punch into the container thereby forcing the billet through the die. After the extrusion forging, the punch is raised to a prescribed level and held there and the container is subsequently raised. Since the undeformed part of the billet is attached fast to the container, the rising container drags the extruded part of the billet out of the die and, at the same time, brings the undeformed part of the billet into powerful collision with the punch and consequently knocks the extrusion forged product out of the container.

2 Claims, 10 Drawing Figures

EXTRUSION FORGING METHOD THEREFOR

BACKGROUND OF THE INVENTION

This invention relates to an extrusion forging method particularly suitable for extrusion forging long products.

The extrusion forging method generally comprises placing a billet in a container and exerting pressure on the billet as held in the container with a punch, for example, thereby extruding the billet through a die. Since this method can be easily performed even on billets of hard metal, it has come to find extensive utility in the fabrication of various parts including automobile parts. Heretofore, the extrusion forging method has been mainly utilized for the fabrication of relatively short rods of circular and complex sections. The reason for the small length of the products is that the production of long rods not merely necessitates application of high pressure during the extrusion forging but also entails a possibility that the fabricated products, when being removed from the die, will be malformed and accordingly lacking in dimensional precision.

SUMMARY OF THE INVENTION

An object of this invention is to provide an extrusion forging method which permits the extrusion forged products to be removed from the die without any malformation.

The present invention attains this object using a double action hydraulic press to support a punch on the inner ram and a container on the outer ram respectively of the press. First, the container is set in position on a die which is fixed in advance, a given billet is placed in the container, and the inner ram is driven to lower the punch to a prescribed depth within the container to effect required extrusion forging. After the extrusion forging, the punch is elevated to a prescribed level and left standing at that level and the outer ram is subsequently driven to raise the container. In this case, since the upper part of the billet still remains undeformed within the container, the extruded part is raised together with the container. Thus, the extruded part is again passed through the die. The container is further raised until the leading end of the extruded part completely departs from the die. In the meantime, the further rise of the container, in effect, allows the punch which is left standing at the elevated level to be inserted therein, with the result that the punch will push the extruded product out of the container. If the extruded part sustains a bend in the course of the extrusion, for example, it will be freed of the bend because it is passed again through the die and because tensile stress is exerted upon the material of the extruded part while the extruded part is being extracted from the die by the container. Further, during the extraction of the extruded product from the container, the extruded part does not sustain any malformation because this extraction proceeds while the undeformed part of the billet is kept in contact with the punch. The extrusion forging performed by this invention, therefore, assures high precision forging even for products of great length.

The other objects and characteristics of the present invention will become apparent from the further disclosure of the invention to be made hereinbelow with reference to the accompanying drawing.

DESCRIPTION OF PREFERRED EMBODIMENT

Figure 1:
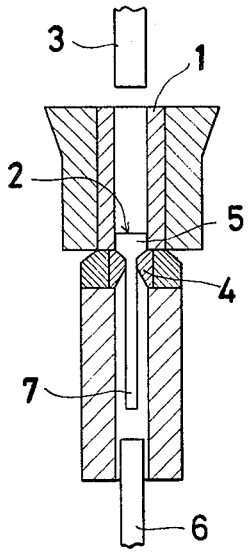
Fig. 1 (PRIOR ART)
FIG. 1 is an explanatory diagram illustrating the conventional extrusion forging method.

The extrusion forging heretofore practiced in the art will be described with reference to FIG. 1.

A billet 2 to be fabricated is placed in a container 1 and a punch 3 is worked to apply pressure downwardly to the upper part of the billet 2 in the container 1. Consequently, the billet 2 is extruded through a die 4 as shaped in a cross section conforming to the cross section of the die 4. In the extrusion of the billet 2 under the pressure of the punch 3, the upper terminal part 5 of the billet 2 remains undeformed within the container 1 even after the thrust of the punch for the extrusion has reached its end. Consequently, the extrusion forged product cannot be removed from the apparatus through the die 4. In the conventional apparatus, therefore, it has been customary for the extrusion forged product to be removed from the apparatus by causing the leading end of the extruded part 7 to be pushed upwardly by a knockout punch 6 thereby permitting the product to be withdrawn in the direction of the undeformed end thereof. In the extrusion forging method, the forging pressure applied by the punch 3 to bear upon the billet 2 is extremely high and, consequently, the extruded part remains partially in tight contact with the die 4. The frictional resistance offered between their surfaces in such tight contact is fairly high. The force with which the knockout punch 6 pushes the leading end of the extruded part therefore is fairly high. Thus, the length of the extruded part 7 has to be limited to the range in which the knockout operation can be effectively performed without inducing the phenomenon of buckling.

Figure 2:
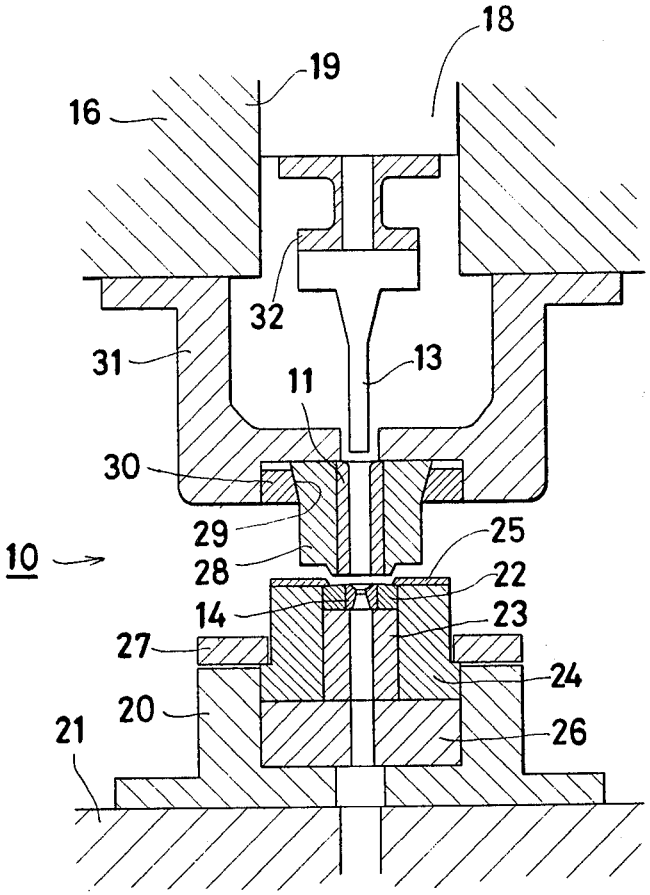
FIG. 2 is a longitudinal cross section illustrating one preferred embodiment of the extrusion forging apparatus according to the present invention.

This invention has been perfected with a view to solving the aforementioned various faults found with the conventional extrusion forging method. It permits the extrusion forged product to be removed from the apparatus without causing the extruded part of the billet to sustain any buckling and, therefore, enables long billets to be effectively extrusion forged to yield forged products of high precision. This invention will be described with reference to FIG. 2.

An extrusion forging apparatus 10 of the present invention is provided with a container 11, a punch 13, and a die 14. It is further provided with a double action hydraulic press 16 which has an inner ram 18 and an outer ram 19 concentrically disposed thereon.

The die 14 is fixed in position and reinforced with a stress ring 22. For the purpose of this positioning, the die 14 is mounted on a cylindrical pressure pad 23 and kept pressed down by a die fixing plate 25, with the periphery thereof restrained with a die holder 24. The die fixing plate 25 is fastened to the die holder 24. The cylindrical pressure pad 23 and the die holder 24 are mounted on the pressure base 26. All these components are held fast to each other by the cooperation of the die holder retainer 27 and the retainer 20. The retainer 20 is fixed on the bolster 21.

The container 11 is positioned above the die 14. The container consists of a hollow cylindrical wall and has the outer surface of the hollow wall kept squeezed with a stress ring 28. By virtue of its slightly converged cross section 29, the stress ring 28 is pressed against the upper case 31 by a fixing plate 30. The fixing plate 30 is fixed to the upper case 31, while the upper case 31 is fastened to the outer ram 19 which is capable of vertical motion. Thus, the container 11 is made to move in the vertical direction above the die 14 by the outer ram 19 of the press 16.

To the upper opening of the container 11 is opposed the leading end of the punch 13. The rear end of the punch 13 is fixed through a load cell 32 to the inner ram 18 which is adapted to be moved in the vertical direction independently of the outer ram 19. When the inner ram 18 is lowered, the punch 13 fits into the container 11 and descends in conjunction therewith.

Now, the operation of extrusion forging to be carried out by use of the extrusion forging apparatus of the construction described above will be described below.

Figure 3:
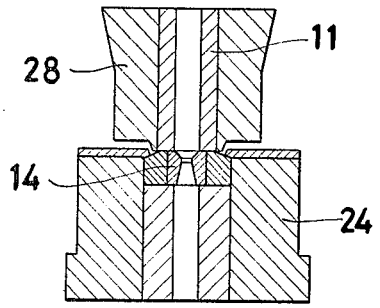
FIGS. 3(A), 3(B), 3(C), 3(D) and 3(E) are explanatory diagrams illustrating a process in which the extrusion forging is carried out by use of the apparatus of FIG. 2.
Figure 3:
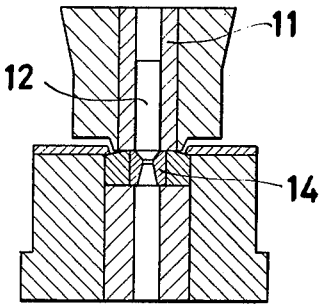
Figure 3:
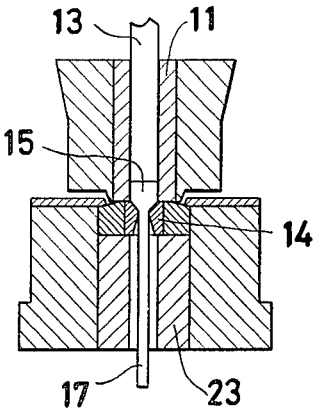
Figure 3:
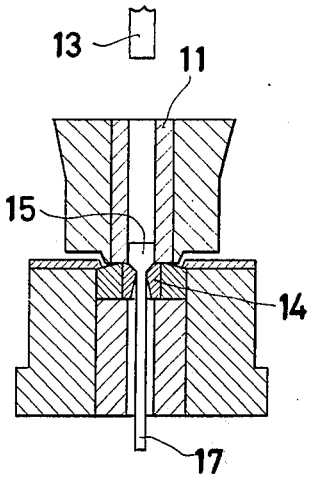
Figure 3:
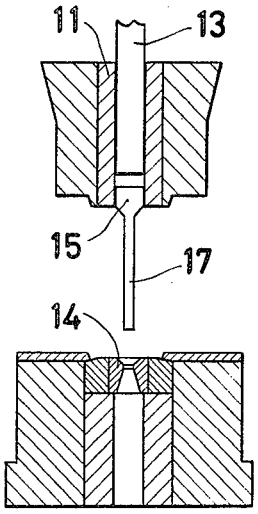

First, the outer ram 19 of the double action hydraulic press 16 is operated to lower the container 11 and set it in position on the die 14 (FIG. 3(A)).

Then, a billet 12 to be extrusion forged is inserted and set in position within the container 11 (FIG. 3(B)). After the billet 12 has been set right, the inner ram 18 of the double action press 16 is operated to lower the punch 13 and allow it to enter the container 11 and apply pressure to bear upon the billet 12. As a result, the billet 12 is forced through the die 14, and extruded in the shape of the die into the cylindrical pressure pad 23 (FIG. 3(C)). By the time that the descent of the punch 13 is terminated, the greater part of the billet 12 has been converted by extrusion forging into an extruded part 17 and the remaining part 15 remains in its original undeformed shape within the container 11. After the punch 13 has been lowered and the extruded part 17 has been formed to a prescribed length, the inner ram 18 is operated to start the punch 13 moving upwardly and allow it to depart from the container 11, reach a prescribed level where it stands by (FIG. 3(D)). Then, the outer ram 19 is operated to raise the container 11. Since the undeformed part 17 of the billet is attached fast to the inner surface of the container 11, the extruded part 17 is lifted together with the container 11 and drawn out of the die (FIG. 3(E)). while the extruded part 17 is being extracted from the die, it is subject to the large tensile force produced by the container 11 and the die 14. If the extruded part 17 happens to have sustained a bend during the extrusion forging, this great tensile force serves to mend the bend. The continued ascent of the container 11 has an effect of enabling the punch 13 left standing by to enter the container 11. When the height of the punch 13 is fixed in advance so that the leading end of the punch 13 comes into contact with the undeformed part 15 of the billet after the time that the leading end of the extruded part 17 has completely departed from the die 14, the punch is enabled to give a push to the upper end surface of the undeformed part of the billet enough for the extrusion forged product to be forced out of the container 11. Consequently, the extrusion forged product can be removed from the extrusion forging apparatus 10 without sustaining any malformation in the extruded portion.

Figure 4:
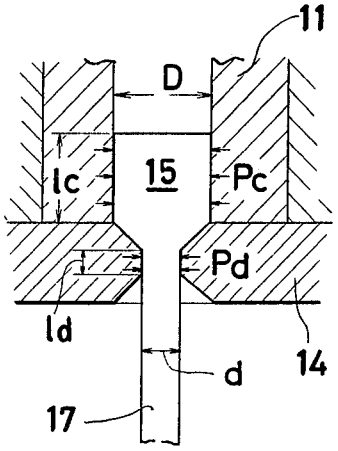
FIG. 4 is an explanatory diagram illustrating the condition of pressure being exerted upon a billet undergoing extrusion forging.

In the extrusion forging method described above, the fact that, during the ascent of the container 11, the undeformed part of the billet remains attached to the container 11 with a fastness greater than the frictional force offered by the die 14 so that the undeformed part is raised in conjunction with the container and the extruded part is consequently drawn out of the die 14. This aspect of the present invention will be described below with reference to FIG. 4.

Let "D" stand for the bore of the container (the outside diameter of the billet to be extrusion forged), "$l_c$" for the length of the undeformed part of the billet remaining in the container, "$P_c$" for the surface pressure exerted at the interface between the undeformed part of the billet and the container, "$\mu_c$" for the frictional coefficient between the undeformed part of the billet and the container, "d" for the inside diameter of the die (the outside diameter of the extruded part), "$l_d$" for the die land length, "$P_d$" for the surface pressure between the extruded part of the billet and die land, and "$\mu_d$" for the frictional coefficient between the extruded part of the billet and the die land, and the following formula (1) will define the requirement for the adhering force produced between the container and the undeformed part of the billet to be greater than the frictional force produced between the die and the extruded part of the billet in order for the extruded part of the billet to be drawn out of the die because of the fastness of the attachment of the undeformed part of the billet to the inner surface of the container.

$$\mu_c \cdot P_c \cdot \pi D \cdot l_c \geqq \mu_d \cdot P_d \cdot \pi d l_d \quad (1)$$

More specifically, because the adhering force of the undeformed part of the billet to the container is determined by the length of the undeformed part of the billet to the diameter of the billet, satisfaction of the formula (2) derived from the aforementioned formula (1) will suffice for the fulfilment of the requirement mentioned above.

$$\frac{l_c}{D} \geqq \frac{\mu_d}{\mu_c} \cdot \frac{P_d}{P_c} \cdot \frac{l_d}{D} \cdot \frac{d}{D} \quad (2)$$

The surface pressure $P_c$ between the undeformed part of the billet and the container and the surface pressure $P_d$ between the extruded part of the billet and the die can be determined only by actual measurement. It can be safely inferred, however, that the ratio of the two surface pressures $P_c$ and $P_d$ is proportional to the flow stress of the materials involved. In case where the extrusion forging is performed under the conditions of 19.8 mm as the diameter of the billet, 20 mm as the bore of the container, and 50 percent as the reduction in area, for example, the equivalent strain of the billet within the container is about 0.02 and the equivalent strain of the extruded part is about 2.0. It can, therefore, be assumed that the mean flow stress exerted on a billet of pure aluminum within the container is about 3 kgf/mm$^2$ and that exerted on the extruded part of the billet is about 11.5 kgf/mm$^2$. The ratio between the surface pressure "$P_c$" to the surface pressure "$P_d$", therefore, is found to be about 3:11.5. On the assumption that the frictional coefficient "$\mu_2$" on the surface of the die is about twice the frictional coefficient "$\mu_c$" on the inner surface of the container and that the die land length is 2 mm, the formula (2) may be developed by using the numerical value mentioned above, as follows:

$$\frac{l_c}{D} = \frac{2}{1} \times \frac{11.5}{3} \times \frac{2}{20} \times \frac{14.14}{20} \approx 0.54$$

This means that when an aluminum billet 20 mm in diameter is extrusion forged into a round bar at 50 percent of reduction in area, with the other conditions ignored for the convenience of discussion here, the fast attachment of the undeformed part of the billet to the container and the safe removal of the extruded part from the die can be obtained by allowing the undeformed part remaining inside the container to have a length of not less than about 11 mm.

To verify these numerical values, billets of aluminum and mild steel were actually subjected to extrusion forging to yield products of circular and complex cross sections.

First, billets made of annealed pure aluminum in dimensions of 20 mm of diameter and 60 mm of length were extrusion forged, with Jonhnson's wax No. 111 as the lubricant, through a die having the shape of a cone with an inlet angle of 60° and involving a die land length of 2 mm, to produce round bars, bars with keyways, and bars with splined ways. The reduction in area was in all cases fixed at about 50 percent (with the extrusion ratio of 2).

Figure 5:
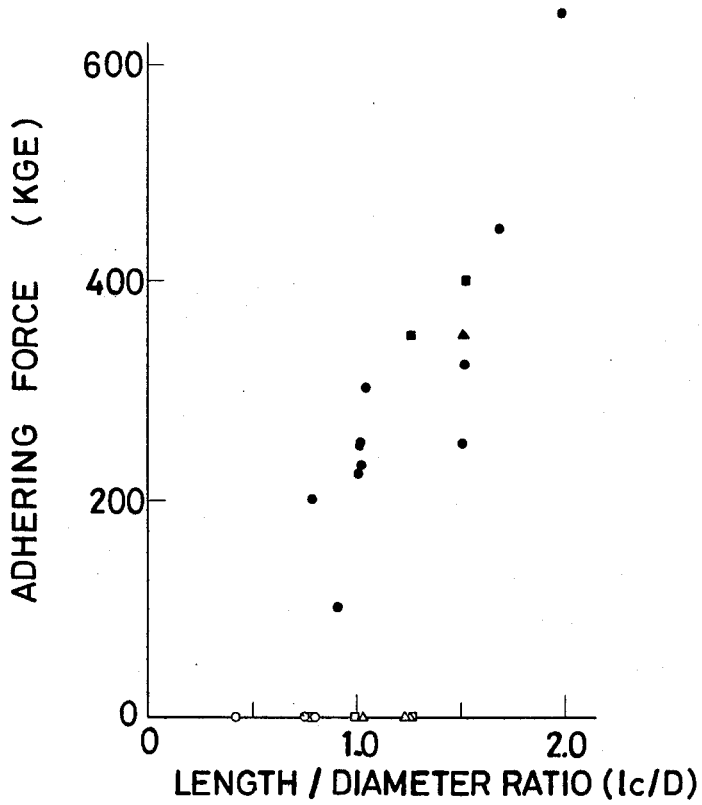
FIG. 5 is a graph showing a typical relation between the adhering force and the length/diameter ratio of an aluminum billet in the container after the extrusion has been carried out by use of the extrusion apparatus of this invention.

These billets were extrusion forged to give undeformed parts of varying length and the extrusion forged products were tested to determine whether or not their undeformed parts would adhere to the container so fast as to permit safe removal of the products from the die. The results were as shown in the graph of FIG. 5. In this graph, the vertical axis shows the adhering force between the undeformed part of the billet and the container and the horizontal axis shows the ratio of the length of the undeformed part of the billet within the container to the diameter thereof. The solid circle (●) represents an extruded bar of a circular section, the solid triangle (▲) an extruded rod of a keyway section, and the solid square (■) an extruded rod of a splined section, while the corresponding blank marks indicate the cases in which the extrusion forged rods remained in the die.

It is noted from the graph that in the case of rods of circular sections, the borderline between adhesion of the extruded products to the container and to the die occurs at a ratio of the length of the undeformed part of the billet in the container to the diameter of the billet of about 0.8. This value is slightly greater than the value 0.54 found by calculation. The reason for this difference is that in the formula of the calculation, the possible increase in the force of extraction due to the slight expansion of the diameter at the leading end of the extruded part and the bend formed in the extruded part were not taken into consideration. In the case of rods of complex sections, safe removal of the extruded part from the die could be obtained without fail so far as the ratio of the length of the undeformed part of the billet remaining within the container to the diameter of the billet was not less than 1.5.

Figure 6:
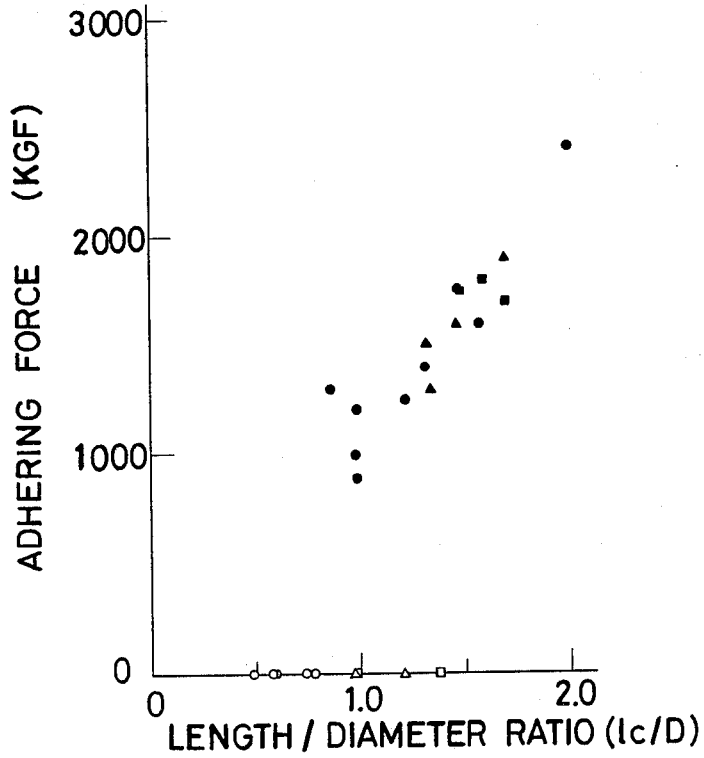
FIG. 6 is a graph showing a typical relation between the adhering force and the length/diameter ratio of a mild steel billet in the container after the extrusion has been carried out by use of the extrusion apparatus of this invention.

The procedure described above was repeated faithfully for extrusion forged rods of a circular section and rods of the same two complex sections as described above, except that mild steel billets (C: 0.17 percent) were used in the place of aluminum billets and a zinc phosphate coating with Bonderlube 235 was used as a lubricant in the place of Johnson's wax. The results were as shown in the graph of FIG. 6. It is noted from the graph that the adhering force of the undeformed part of the billet to the container was about five times that obtained in the case of aluminum billets and that adhesion of the extrusion forged product to the container sufficient to permit safe removal of the product from the die could be obtained without fail when the ratio of the length of the undeformed part of the billet remaining within the container to the diameter of the billet was not less than 0.9 in the case of rods of a circular section and not less than 1.5 in the case of rods of complex sections such as shafts with keyway sections or splined sections.

The adhering force of the extrusion forged product to the die is affected by the material of the billet, the die angle, the die land length, the reduction in area, the type of lubricant, the speed of extrusion forging, the shape of the product, the swell in the diameter of the extruded part, the bend formed, etc. The experiments conducted by the inventors so far have ascertained that the extrusion forged product adheres to the container fast enough to permit safe removal of the product from the die without reference to the manner of extrusion forging and regardless of cross-sectional complexity whenever the length of the undeformed part of the billet remaining within the container is at least about 1.5 times the diameter of the billet.

The value mentioned above represents the minimum limit. This length may be increased when the undeformed part of the billet is intended for some specific use. The appropriate length of the billet to be extrusion forged and the length of the billet to be left undeformed within the container can easily be fixed when the length of the extruded part and the reduction in area are known in advance. Further, the undeformed part of the billet to be left within the container can be given an ample length by having the downward thrust of the punch properly fixed in advance.

As is clear from the description given above, the extrusion forged product obtained by this invention is not required to be struck at one end thereof with a knockout punch so as to be pushed in the reverse direction. Thus, the extruded part of the billet has no possibility of sustaining any malformation during its removal from the die. This invention, accordingly, enables billets of greater length to be advantageously extrusion forged without being malformed. Generally, the extruded product sustains a slight bend during the extrusion forging. Since the present invention provides for extraction of the product from the die under tensile stress, the bend is mended during the forced extraction. The product, therefore, enjoys improved dimensional accuracy.

What is claimed is:

1. A method for extrusion forging a billet, comprising the steps of:

(a) extruding a billet through a die by applying pressure to the billet held in a container by means of a punch having a length larger than that of said container until an undeformed part of said billet remains within said container, said die being disposed on the leading end of said container;

(b) withdrawing said punch from said container to a predetermined level upon completion of the extrusion;

(c) maintaining said punch at said predetermined level;

(d) reforming the extruded part of said billet by withdrawing said extruded part from said die by moving said container away from said die while holding fast thereto the undeformed part of said billet; and (e) removing said undeformed part of said billet from said container by moving said container to the predetermined position of said punch so that said punch is inserted into said container by said movement to collide with and exert a pressure upon the upper surface of the undeformed part of the billet remaining within said container, thereby separating from said container the extrusion forged product having its one end connected with the undeformed part of said billet.

2. A method for extrusion forging a billet, which comprises applying pressure to a billet held in a container by means of a punch having a length larger than that of said container thereby extruding the billet through a die disposed on the leading end of said container until the undeformed part of the billet having a length at least 1.5 times the diameter of said container remains within said container; allowing said punch, upon completion of the extrusion, to be pulled out of said container, raised to a prescribed level and retained there; raising said container holding fast thereto the undeformed part of the billet thereby withdrawing the extruded part of the billet from said die to reform the extruded part of the billet and simultaneously allow said punch retained at the prescribed level to enter the ascending container; and further raising said container thereby allowing said punch to be inserted into said container and to collide with and exert a pressure upon the upper surface of the undeformed part of the billet remaining within said container, thereby separating from said container the extrusion forged product having its one end connected with the undeformed part of the billet.

* * * * *

UNITED STATES PATENT AND TRADEMARK OFFICE

CERTIFICATE OF CORRECTION

PATENT NO. : 4,425,774

DATED : JANUARY 17, 1984

INVENTOR(S) : SHINOZAKI ET AL

It is certified that error appears in the above—identified patent and that said Letters Patent is hereby corrected as shown below:

Cover page, in the title, change same to read --EXTRUSION FORGING METHOD--.

Signed and Sealed this

*Third* Day of *July 1984*

[SEAL]

*Attest:*

GERALD J. MOSSINGHOFF

*Attesting Officer*

*Commissioner of Patents and Trademarks*